US006262688B1

(12) United States Patent
Kasahara

(10) Patent No.: US 6,262,688 B1
(45) Date of Patent: Jul. 17, 2001

(54) ANTENNA SYSTEM AND METHOD FOR CONTROLLING ANTENNA SYSTEM

(75) Inventor: Akihiro Kasahara, Ooami-Shirasato-Machi (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/465,447

(22) Filed: Dec. 17, 1999

(30) Foreign Application Priority Data

Dec. 18, 1998 (JP) ..... 10-361457

(51) Int. Cl.[7] ..... H01Q 3/00
(52) U.S. Cl. ..... 343/766; 343/765; 343/911 L
(58) Field of Search ..... 343/766, 753, 343/754, 757, 911 R, 911 L, 765, 761

(56) References Cited

U.S. PATENT DOCUMENTS

| | | | | |
|---|---|---|---|---|
| 4,531,129 | | 7/1985 | Bonebright et al. . | |
| 5,781,163 | * | 7/1998 | Ricardi et al. | 343/911 R |
| 5,821,908 | * | 10/1998 | Sreenivas | 343/911 R |
| 5,838,276 | | 11/1998 | Chapman et al. . | |

FOREIGN PATENT DOCUMENTS

| | | |
|---|---|---|
| 0 707 356 | 4/1996 | (EP) . |
| 2 770 343 | 4/1999 | (FR) . |
| 6-291532 | 10/1994 | (JP) . |
| 8-307139 | 11/1996 | (JP) . |
| 9-230018 | 9/1997 | (JP) . |

OTHER PUBLICATIONS

C. M. Johnson, IBM Technical Disclosure Bulletin, vol. 5, No. 8, pp. 105–106, "Millimeter Wave Search System", Jan. 1, 1963.

* cited by examiner

*Primary Examiner*—Tan Ho
*Assistant Examiner*—Ephrem Alemu
(74) *Attorney, Agent, or Firm*—Oblon, Spivak, McClelland, Maier & Neustadt, P.C.

(57) ABSTRACT

An antenna system of the invention includes a plurality of antenna devices respectively configured to send or receive a plurality of radio beams, a plurality of electric feeding units respectively holding the plurality of antenna devices and a spherical lens having a center and causing the plurality of radio beam to converge into the plurality of antenna devices respectively. A holding rail holds the plurality of electric feeding units in such a manner that the plurality of antenna devices are movable along a substantially constant distance from the center of the spherical lens. According to the antenna system, the plurality of electric feeding units can be arranged for one spherical lens to follow the plurality of satellites. Thus, the antenna system can be arranged in a smaller space.

19 Claims, 10 Drawing Sheets

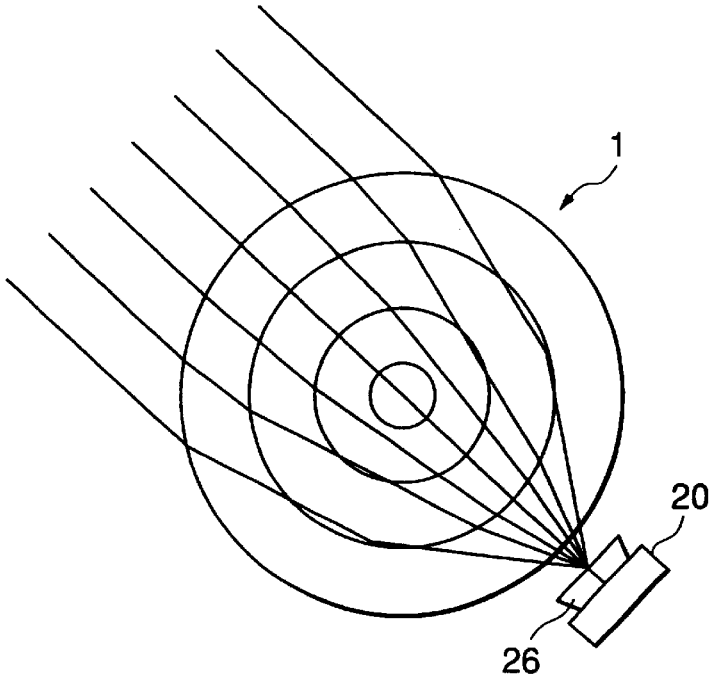
FIG.2
FIG.3a
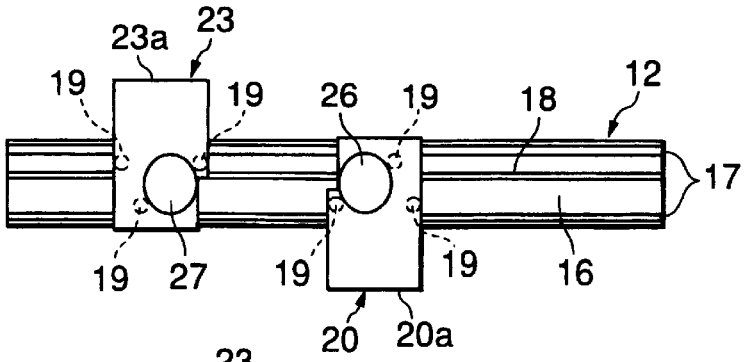
FIG.3b
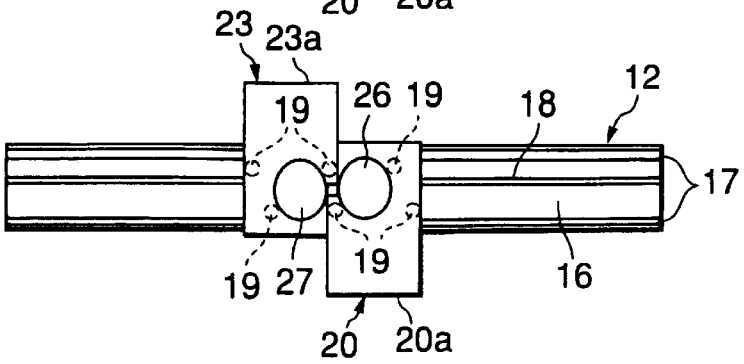

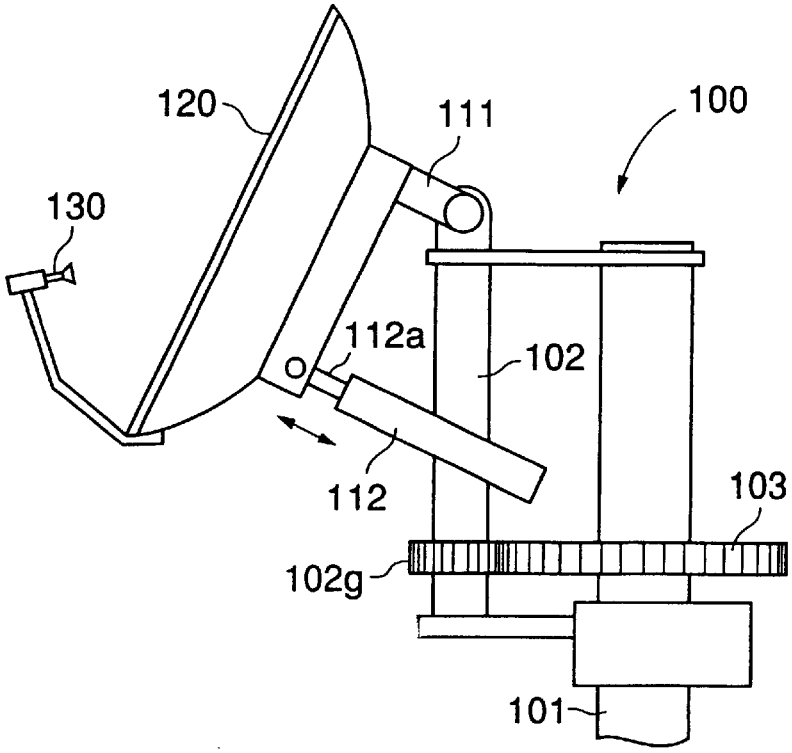
PRIOR ART FIG.12
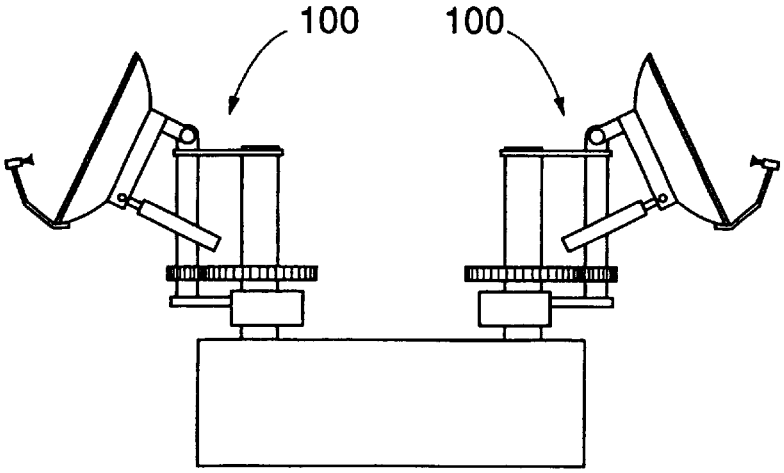
PRIOR ART FIG.13

ANTENNA SYSTEM AND METHOD FOR CONTROLLING ANTENNA SYSTEM

BACKGROUND OF THE INVENTION

1. Field of the Invention

This invention relates to an antenna system and a method for controlling an antenna system, in particular, to an antenna system and a method for controlling an antenna system that can follow a plurality of communication satellites at substantially the same time.

2. Description of the Related Art

About 200 communication satellites have already gone around the earth at relatively low altitudes. Thus, we can communicate with at least some communication satellites wherever we are on the earth. The "Ilizium system" and the "Sky-bridge system" have already been proposed as systems using the communication satellites.

Parabola antenna systems or phased array antenna systems are generally used as conventional antenna systems for the communication satellites.

FIGS. 12 and 13 show an example of the conventional parabola antenna system. As shown in FIG. 12, the parabola antenna system 100 includes: a post 101 vertically standing on the ground or on a building; a rotatable shaft 102 mounted on an upper end of the post 101 in such a manner that the shaft 102 is parallel with and can rotate around an axis of the post 101; a gear 102*g* fitted to the rotatable shaft 102; and a gear 103 engaged with the gear 102*g* and driven by a motor (not shown).

An upper portion of a radio beam converging unit 120 is attached to a bracket 111. The bracket 111 is supported by an upper end of the rotatable shaft 102 in such a manner that the bracket 111 can vertically pivot to the upper end of the rotatable shaft 102. A lower portion of the radio beam converging unit 120 is attached to a front end of a movable rod 112*a* in a cylinder unit 112. The cylinder unit 112 is fixed to a lower portion of the rotatable shaft 102. An electric feeding unit 130 is disposed at a converged position into which a radio beam converges due to the radio beam converging unit 120.

The above described parabola antenna system 100 operates as follows. The motor (not shown) is driven to rotate the rotatable shaft 102 via the gears 103 and 102*g*, in order to control a horizontal angle of the radio beam converging unit 120. In addition, the cylinder unit 112 is actuated to slide the movable rod 112 to a desired position, in order to control an elevation angle of the radio beam converging unit 120. Thus, the parabola antenna 100 can follow a communication satellite. That is, the radio beam converging unit 120 can face to the communication satellite to receive a radio beam outputted from the communication satellite in a good communication state, or to send a radio beam to the communication satellite in a good communications state.

As described above, the conventional parabola antenna system 100 has one radio beam converging unit 120 corresponding to one electric feeding unit 130. Thus, when the number of satellites to follow is more than one, the same number of parabola antenna systems 100 are necessary. For example, when the number of satellites to follow is two, two parabola antenna systems 100 are necessary.

Then, the two parabola antenna systems 100 have to be arranged in such a manner that one or the other of the parabola antenna systems 120 may not be an obstacle between the other or the one of the parabola antenna systems 120 and the satellite corresponding to the one or the other of the parabola antenna system. For example, when each of the radio beam converging units 120 has a circular shape with a diameter of 45 cm, as shown in FIG. 13, the two radio beam converging units 120 have to be arranged substantially horizontally and away from each other at a distance of about 3 m. If not, one of the radio beam converging units 120 may shade the other of the radio beam converging units 120.

However, the arrangement shown in FIG. 13 requests a larger space. Thus, it is difficult to spread the arrangement to common houses.

SUMMARY OF THE INVENTION

Therefore, the object of this invention is to provide an antenna system that can follow a plurality of satellites and that is compact and capable of being arranged in a smaller space.

To achieve the above object, this invention is characterized by following features. That is, this invention is an antenna system including; a plurality of antenna devices respectively configured to send or receive a plurality of radio beams, a plurality of electric feeding units respectively holding the plurality of antenna devices, a spherical lens having a center and causing the plurality of radio beam to converge into the plurality of antenna devices respectively, and a holding rail holding the plurality of electric feeding units in such a manner that the plurality of antenna devices are movable along a substantially constant distance from the center of the spherical lens.

According to the feature, the plurality of electric feeding units (the plurality of the antenna devices) can be arranged for one spherical lens to follow the plurality of satellites. Thus, the antenna system can be arranged in a smaller space.

Preferably, the antenna system further includes: a fixed base, a rotational base mounted on the fixed base and rotatable around a first axis through the center of the spherical lens, and a supporting element fixed on the rotational base and supporting the holding rail rotatably around a second axis which is perpendicular to the first axis and which passes through the center of the spherical lens.

In the case, the antenna system may prevent interference in the movements of the plurality of electric feeding units with each other. Especially, when the number of the electric feeding units is two, the interference in the movements of the two electric feeding units may be extremely effectively prevented.

Preferably, the plurality of antenna devices are capable of substantially adjoining to each other when the plurality of electric feeding units come close to each other.

The supporting element also may support the spherical lens.

The holding rail may have an arc-shaped arm, at least one of whose ends is supported by the supporting element.

The antenna system may include a controlling unit configured to control a rotation of the rotational base around the first axis, a rotation of the arc-shaped arm around the second axis and a movement of each of the plurality of electric feeding units along the holding rail.

The antenna system may include conductors respectively connected with the electric feeding units, wherein the conductors pass through a portion of the rotational base substantially adjacent to the first axis toward the fixed base. In the case, each of the conductors may have an optical transmitting device in order to transmit an optical signal between the rotational base and the fixed base. Preferably, the optical transmitting device can transmit a plurality of optical signals at a time by using lights having different wavelengths.

Preferably, the antenna system may include a cover wall sealingly covering the plurality of electric feeding units, the spherical lens and the holding rail. In the case, the antenna system may include a lens holding member attached to the cover wall and holding the spherical lens. Alternatively, the spherical lens may be supported by the cover wall. The cover wall may be made of a material having a low thermal conductivity. Alternatively, the cover wall may consist of a layer configured to reflect infrared rays, a layer configured to absorb light and an insulating layer. In addition, the cover wall may have a window which is made of a material having a lower transmittance for infrared rays than for visible rays.

In addition, this invention is characterized by following features. That is, this invention is a method of controlling an antenna system comprising: two antenna devices respectively configured to send or receive two radio beams, two electric feeding units respectively holding the two antenna devices, a spherical lens having a center and causing the two radio beams to converge into the two antenna devices respectively, a holding rail holding the two electric feeding units in such a manner that the two antenna devices are movable along a substantially constant distance from the center of the spherical lens, a rotational base mounted on the fixed base and rotatable around a first axis through the center of the spherical lens, and a supporting element fixed on the rotational base and supporting the holding rail rotatably around a second axis which is perpendicular to the first axis and which passes through the center of the spherical lens, said method being a method for positioning the two electric feeding units to two aimed positions corresponding to positions of two satellites in a sky, comprising:

inputting the positions of the two satellites into the controlling unit, calculating the two aimed positions which the two electric feeding units should be positioned to and wherein the two antenna devices are respectively on axes extending from the inputted positions of the two satellites through the center of the spherical lens, rotating the rotational base in such a manner that the second axis is positioned on a crossing line of a first imaginary plane including the two aimed positions and the center of the spherical lens and a second imaginary plane including the center of the spherical lens and perpendicular to the first axis, and rotating the holding rail around the second axis and moving the two electric feeding units along the holding rail to the aimed positions respectively.

According to the feature, the two electric feeding units may be moved to the aimed positions corresponding to the positions of the two satellites respectively, without their interference.

The method may further include: searching a position of one of the two satellites after movement thereof, calculating new two aimed positions which the two electric feeding units should be positioned to and wherein the two antenna devices are respectively on axis extending from the searched position of the one satellite through the center of the spherical lens and on axis extending from the position of the other satellite before searching through the center of the spherical lens, rotating the rotational base in such a manner that the second axis is positioned on a crossing line of a first imaginary plane including the new two aimed positions and the center of the spherical lens and the second imaginary plane, rotating the holding rail around the second axis and moving the two electric feeding units along the holding rail to the new aimed positions respectively, searching a position of the other satellite after movement thereof, calculating further new two aimed positions which the two electric feeding units should be positioned to and wherein the two antenna devices are respectively on axis extending from the searched position of the one satellite through the center of the spherical lens and on axis extending from the searched position of the other satellite through the center of the spherical lens, rotating the rotational base in such a manner that the second axis is positioned on a crossing line of a first imaginary plane including the further new two aimed positions and the center of the spherical lens and the second imaginary plane, and rotating the holding rail around the second axis and moving the two electric feeding units along the holding rail to the further new aimed positions respectively.

Alternatively, the method may include: searching positions of the two satellites after movements thereof, calculating new two aimed positions which the two electric feeding units should be positioned to and wherein the two antenna devices are respectively on axes extending from the searched positions of the two satellites through the center of the spherical lens, rotating the rotational base in such a manner that the second axis is positioned on a crossing line of a first imaginary plane including the new two aimed positions and the center of the spherical lens and the second imaginary plane, and rotating the holding rail around the second axis and moving the two electric feeding units along the holding rail to the new aimed positions respectively.

The method may further include: changing correspondences between the two electric feeding units and the two satellites in the sky each other.

BRIEF DESCRIPTION OF THE DRAWINGS

FIG. 2 is a schematically view for showing an operation of the spherical lens of the antenna system shown in FIG. 1;

FIGS. 3*a* and 3*b* are schematically views of the electric feeding units seen from a side of the spherical lens;

FIG. 12 is a schematically view of a conventional antenna system; and

FIG. 13 is a schematically view for showing an example of arrangement of two conventional antenna systems.

BEST MODE FOR CARRYING OUT THE INVENTION

Embodiments of the invention will now be described in more detail with reference to attached drawings.

Figure 1:
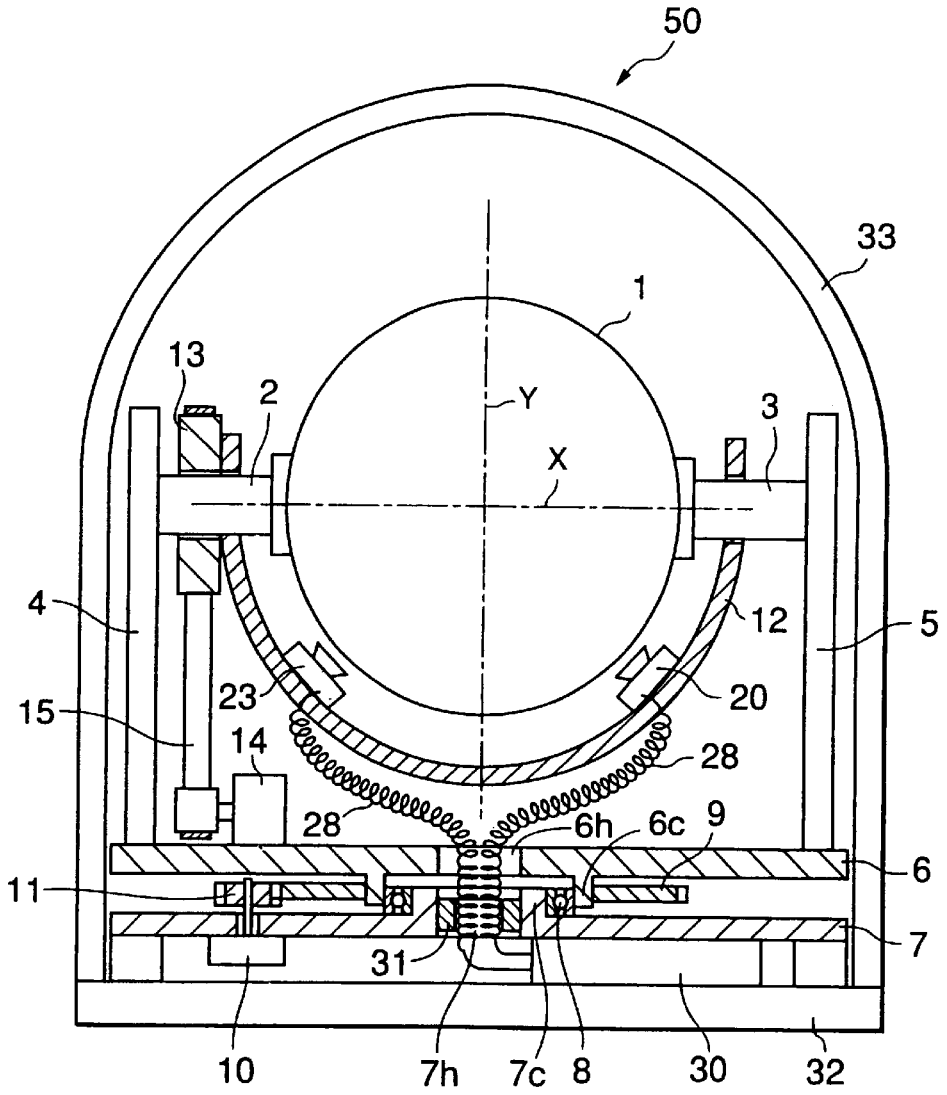
FIG. 1 is a schematically longitudinal sectional view of a first embodiment of the antenna system according to the invention.

FIG. 1 is a schematically longitudinal sectional view of a first embodiment of the antenna system 50 according to the invention. As shown in FIG. 1, the antenna system 50 includes: a fixed base 32 fixed on the ground or on a building; a rotational base 6 provided above on the fixed base 32 rotatably around a first axis Y; and a spherical lens 1 having a center arranged on the first axis Y. The fixed base 32 has a substantially circular shape. The rotational base 6 also has a substantially circular shape.

The spherical lens 1 is supported by a pair of supporting elements on the rotational base 6 via opposite portions thereof. That is, the pair of supporting elements are arranged on the opposite sides of the spherical lens 1, and respectively pass through a second axis X. The second axis X is perpendicular to the first axis Y and passes through the center of the spherical lens 1. The supporting elements consist of supporting columns 4 and 5 standing parallel to the first axis Y and supporting bars 2 and 3 extending from the columns 4 and 5 toward the center of the spherical lens 1 along the second axis X.

In this embodiment, a fixed stage 7 is formed on the fixed base 32. A protruded substantially circular ring 7*c* concentric with the first axis Y is provided on an upper surface in the middle portion of the fixed stage 7. On the other hand, a protruded ring 6*c* concentric with the first axis Y and having a larger diameter than the ring 7*c* is provided on an under surface in the middle portion of the rotational base 6. The protruded ring 6*c* of the rotational base 6 is fitted on an outer periphery of the protruded ring 7*c* via a bearing 8. The rotational base 6 has a hole 6*h* at a portion including or adjacent to the first axis Y to guide conductors 28. Similarly, the fixed stage 7 has a hole 7*h* at a portion including or adjacent to the first axis Y to guide the conductors 28.

A rotational gear 9 concentric with the first axis Y is fitted on an outer periphery of the protruded ring 6*c*. The rotational gear 9 engages with a transmitting gear 11. The transmitting gear 11 is adapted to be driven by a motor 10, which is disposed in a space between the fixed stage 7 and the fixed base 32.

An arc-shaped arm 12 (holding rail) is supported by the supporting bars 2 and 3, rotatably around the second axis X. The arc-shaped arm 12 is arranged to be concentric with the spherical lens 1, that is, away at a substantially constant distance from the center of the spherical lens 1. The arc-shaped arm 12 is fixed to an elevation angle adjusting gear 13, which is attached to the supporting bar 2 concentrically with the second axis X. The elevation angle adjusting gear 13 is connected to an elevation angle adjusting motor 14 disposed on the rotational base 6, via a belt with teeth 15.

Two electric feeding units 20 and 23 are provided in such a manner that they are facing to the spherical lens 1 and capable of moving along the arc-shaped arm 12. A controlling unit 30 is provided in a space between the fixed stage 7 and the fixed base 32. The two electric feeding units 20 and 23 are connected to the controlling unit 30 by the conductors 28 so that electric power can be fed to the electric feeding units 20 and 23 and that various signals can be transmitted (sent or received) with each other. The controlling unit 30 is also connected to the motor 10 and the elevation angle adjusting motor 14 via conductors not shown.

The conductors 28 connected to the electric feeding units 20 and 23 pass through the hole 6*h* of the rotational base 6 (substantially adjacent to the first axis Y), extend toward the fixed base 32, pass through the hole 7*h* of the fixed stage 7 and extend to the controlling unit 30. A fixing bush 31 consisting of an elastic material such as a rubber is inserted and fixed into an inner periphery of the hole 7*h*, in order to protect the conductors 28 from damage caused by sliding or friction. In the case, the conductors 28 are respectively wound in spiral in order to prevent breaking thereof.

A cap-shaped cover wall 33 is joined to the fixed base 32 in such a manner that the cover wall 33 covers the spherical lens 1, the supporting columns 4 and 5 and movable area of the arc-shaped arm 12. Thus, all the elements or components described above are sealed from the outside world. The cover wall is made of a material having a high electric-beam permeability and a low thermal conductivity, such as a resin. On the other hand, the fixed base 32 is made of a material having a high thermal conductivity, such as a metal.

The spherical lens 1 is also called a spherical dielectric lens. The spherical lens 1 consists of integrated dielectric spherical layers. A parallel radio beam converges into a point when the radio beam passes through the spherical lens 1.

FIG. 2 is a schematically view for showing an operation of the spherical lens 1. In the case shown in FIG. 2, the spherical lens 1 consists of integrated four dielectric layers. Of course, the number of integrated dielectric layers may be chosen freely. In general, a dielectric constant of an outer dielectric layer is smaller than that of an inner layer.

Figure 4:
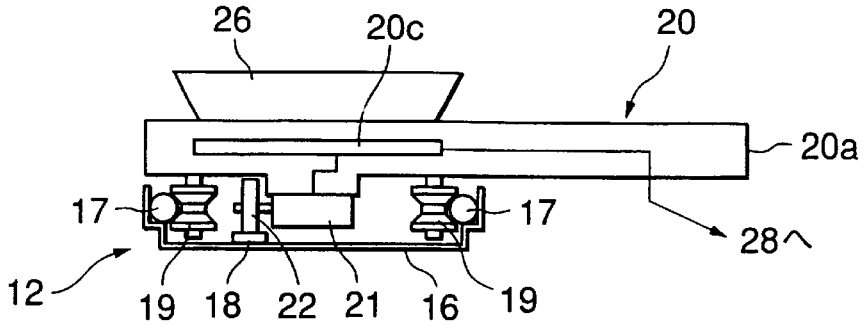
FIG. 4 is schematically sectional view of the electric feeding unit shown in FIG. 1.

A relationship between the arc-shaped arm 12 and the electric feeding units 20 and 23 is explained in detail with reference to FIGS. 3*a*, 3*b* and 4. FIGS. 3*a* and 3*b* are schematically views of the arc-shaped arm 12 with the two electric feeding units 20 and 23 seen from a side of the center of the spherical lens 1. FIG. 4 is schematically sectional view of the arc-shaped arm 12 and the electric feeding unit 20.

As shown in FIGS. 3*a*, 3*b* and 4, the arc-shaped arm 12 has an arm plate 16, a pair of tubular rails 17 arranged on opposite side edge portions of the arm plate 16 and a rack-gear rail 18 placed on an inner surface of the arm plate 16.

As shown in FIG. 4, the electric feeding unit 20 has an antenna device 26 configured to send and/or receive a radio beam, a circuit board 20*c* configured to process the radio beam and a housing body 20*a* containing the circuit board 20*c*. The circuit board 20*c* is connected to the conductor 28.

As shown in FIGS. 3*a*, 3*b* and 4, three V-shaped bearings 19, a guiding gear 22 and a guiding motor 21 are provided on a surface of the housing body 20*a* facing to the arm plate 16. The three V-shaped bearings 19 are adapted to contact and slide with respect to the pair of tubular rails 17. The guiding gear 22 engages with the rack-gear rail 18 and is adapted to be driven by the guiding motor 21. The guiding motor 21 is connected to the controlling unit 30 through the circuit board 20*c* and the conductor 28.

As shown in FIGS. 3*a* and 3*b*, the electric feeding unit 23 is substantially the same as the electric feeding unit 20, although the electric feeding unit 23 has an antenna device 27 and a housing body 23*a* instead of the antenna device 26 and the housing body 20*a*.

As shown in FIGS. 3*a* and 3*b*, the antenna devices 26, 27 are arranged at the facing edge portions of the respective housing bodies 20*a* and 23*a* so that the antenna devices 26, 27 are capable of substantially adjoining to each other when the housing bodies 20*a* and 23*a* come closest to each other.

In addition, the controlling unit 30 is connected to a host system not shown, and is adapted to be inputted information relating to positions of satellites.

Figure 5:
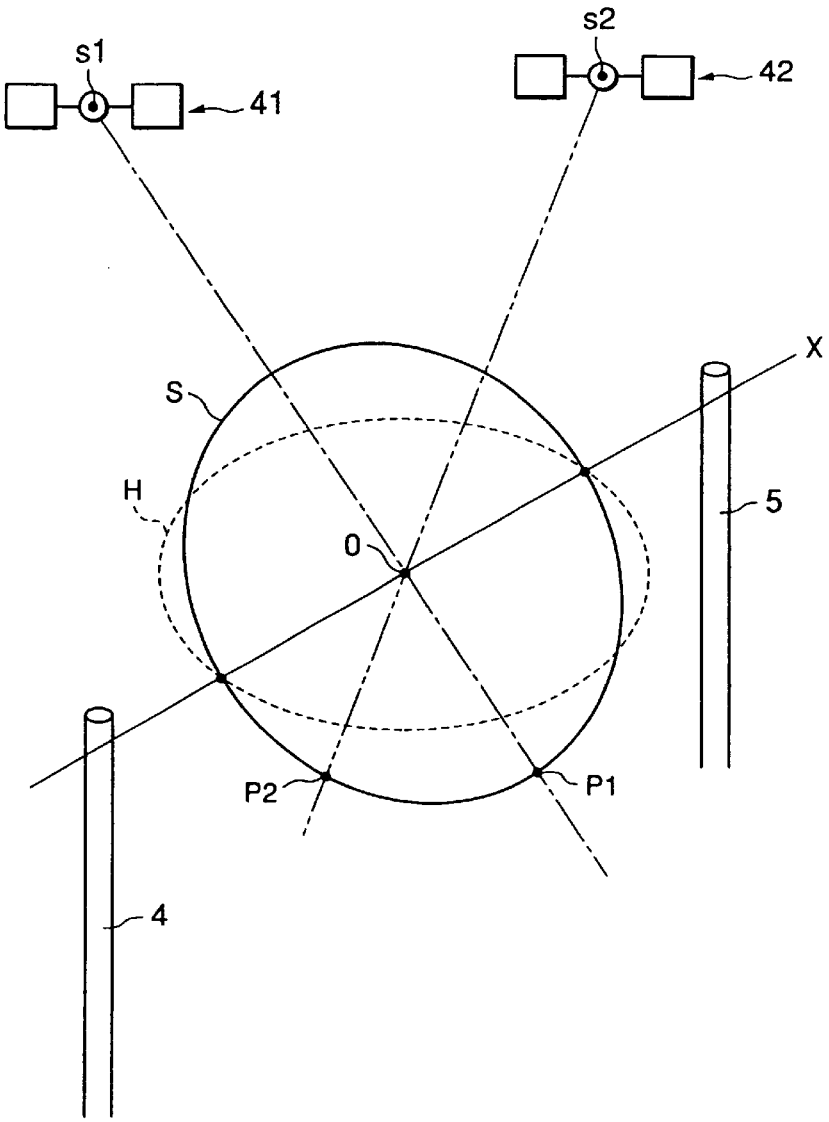
FIG. 5 is a schematically perspective view of the antenna system for showing a control operation of positioning the electric feeding units shown in FIG. 1.
Figure 6:
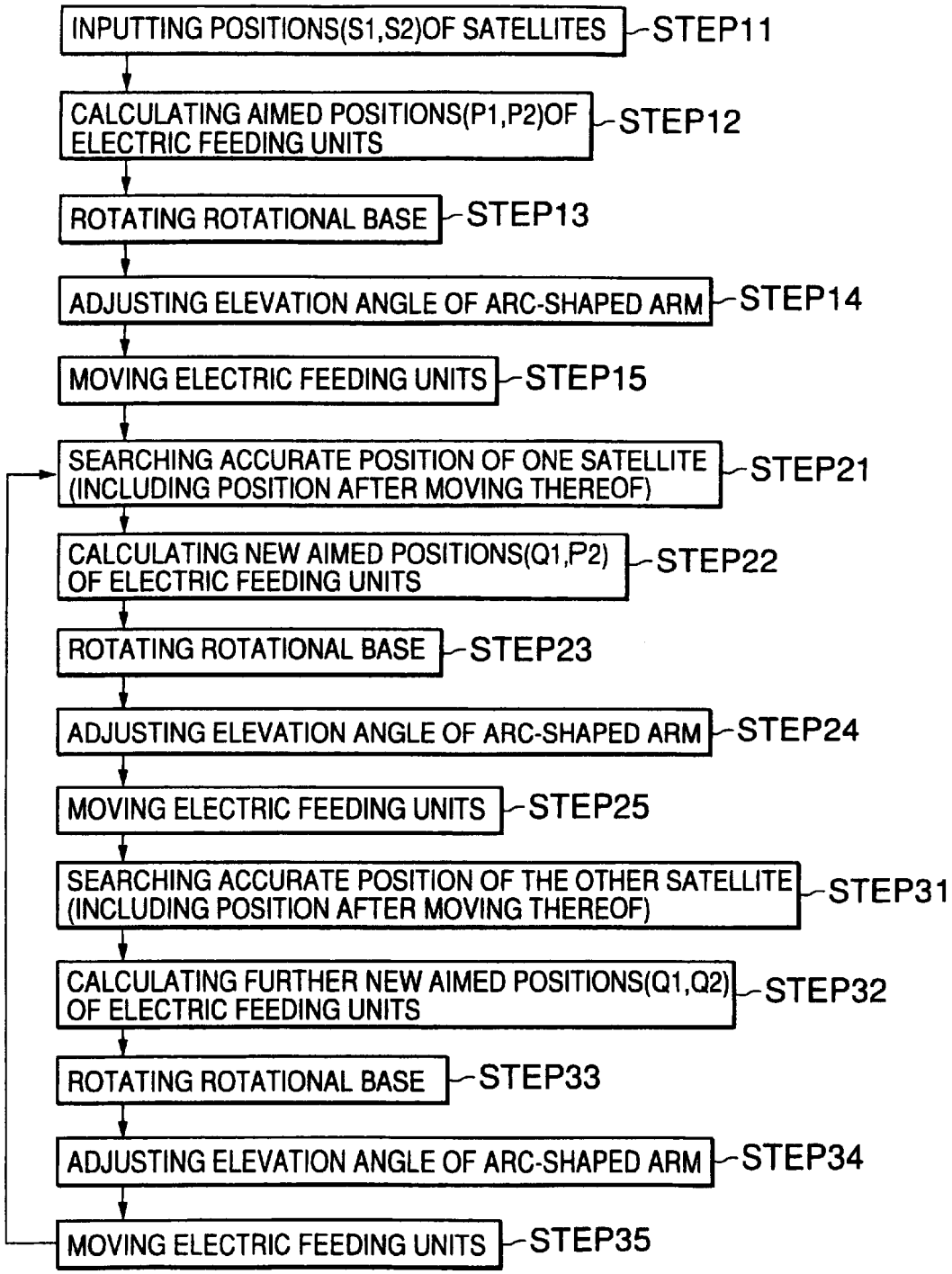
FIG. 6 is a flow chart of the control operation of positioning the electric feeding units shown in FIG. 1.

Then, an operation of the antenna system of the first embodiment described above is explained with reference to FIGS. 5 and 6. FIG. 5 is a schematically perspective view of the antenna system for showing a control operation of positioning the electric feeding units. FIG. 6 is a flow chart of the control operation of positioning the electric feeding units.

As shown in FIG. 6, rough positions s1 and s2 of chosen two communicatable satellites 41 and 42 are inputted into the controlling unit 30 from the host system (STEP 11).

As shown in FIG. 5, the controlling unit 30 calculates two aimed positions P1 and P2 where the electric feeding units 20 and 23 (in detail the antenna devices 26 and 27) should be positioned (STEP 12). The aimed positions P1 and P2 are respectively on axes a1 and a2 extending from the inputted positions s1 and s2 of the two satellites through the center of the spherical lens 1.

Then, the controlling unit 30 drives the motor 10 to rotate the rotational base 6 in such a manner that the second axis X is positioned on a crossing line of a first imaginary plane S including the two aimed positions P1 and P2 and the center O of the spherical lens 1 and a second imaginary plane H including the center O of the spherical lens 1 and perpendicular to the first axis Y (STEP 13).

After the rotating of the rotational base 6 or simultaneously therewith, the controlling unit 30 drives the elevation angle adjusting motor 14 to rotate the arc-shaped arm 12 around the second axis X. Thus, the arc-shaped arm 12 is positioned in such a manner that the arc-shaped arm 12 passes through the aimed positions P1 and P2 (STEP 14).

After the driving of the elevation angle adjusting motor 14 or simultaneously therewith, the controlling unit 30 drives the respective guiding motors 21 of the electric feeding units 20 and 23. Thus, the electric feeding units 20 and 23 are moved along the arc-shaped arm 12 to the aimed positions P1 and P2 respectively (STEP 15). That is, positioning of the electric feeding units 20 and 23 in an initial stage is achieved.

The two satellites 41 and 42 go around the earth along their respective orbits at such high speeds that it takes only about 10 minutes for the respective satellites to sink under a horizon after appearing from the horizon. The antenna system 50 of the first embodiment may follow the satellites 41 and 42 which move at such high speeds, as follows.

After the positioning in the initial stage, an accurate position of one of the two satellites 41 and 42, for example an accurate position of the satellite 41 (including a position after moving of the satellite 41), is searched (first searching step: STEP 21). The search of the accurate position of the satellite 41 may be carried out as follows.

At first, the elevation angle adjusting motor 14 is driven by a small amount in both directions to rotate the arc-shaped arm 12 around the second axis X by a small amount in both directions. At the same time, the guiding motor 21 of the electric feeding unit 20, which is roughly positioned on the arc-shaped arm 12 correspondingly to the satellite 41, is driven by a small amount in both directions to move the electric feeding unit 20 along the arc-shaped arm 12 by a small amount in both directions. Thus, the electric feeding unit 20 moves in a two-dimensional small spherical surface.

During the movement in the small spherical surface, the controlling unit 30 searches a position Q1 where the electric feeding unit 20 should be positioned for providing a better communication state between the satellite 41 and the electric feeding unit 20. The communication state may be judged by watching the intensity of receiving signals or the like. The position Q1 is thought to be on axis extending from the accurate position of the satellite 41 through the center O of the spherical lens 1. That is, by searching the position Q1, we can find the accurate position of the satellite 41.

Then, the controlling unit 30 calculates and confirms the new two aimed positions Q1 and P2 where the electric feeding units 20 and 23 should be positioned. The new two aimed positions Q1 and P2 are respectively on axis extending from the searched position of the one satellite 41 through the center O of the spherical lens 1 and on axis extending from the position of the other satellite 42 before searching through the center O of the spherical lens 1 (STEP 22).

Then, the controlling unit 30 drives the motor 10 to rotate the rotational base 6 in such a manner that the second axis X is positioned on a crossing line of a first imaginary plane S including the two aimed positions Q1 and P2 and the center O of the spherical lens 1 and the second imaginary plane H (STEP 23).

After the rotating of the rotational base 6 or simultaneously therewith, the controlling unit 30 drives the elevation angle adjusting motor 14 to rotate the arc-shaped arm 12 around the second axis X. Thus, the arc-shaped arm 12 is positioned in such a manner that the arc-shaped arm 12 passes through the aimed positions Q1 and P2 (STEP 24).

After the driving of the elevation angle adjusting motor 14 or simultaneously therewith, the controlling unit 30 drives the respective guiding motors 21 of the electric feeding units 20 and 23. Thus, the electric feeding units 20 and 23 are moved along the arc-shaped arm 12 to the aimed positions Q1 and P2 respectively (STEP 25). That is, positioning of the electric feeding unit 20 to follow the satellite 41 is achieved while the position P2 of the electric feeding unit 23 is kept. This control operation is called a non-interference control operation.

After the positioning of the electric feeding unit 20 to follow the satellite 41, an accurate position of the other satellite 42 at a current time (including a position after moving of the satellite 42) is searched (second searching step: STEP 31). The search of the accurate position of the satellite 42 may be carried out similarly to that of the satellite 41.

The controlling unit 30 calculates and confirms further new two aimed positions Q1 and Q2 where the electric feeding units 20 and 23 should be positioned. The further new two aimed positions Q1 and Q2 are respectively on axis extending from the position of the one satellite 41 searched by the first searching step through the center O of the spherical lens 1 and on axis extending from the position of the other satellite 42 searched by the second searching step through the center O of the spherical lens 1 (STEP 32).

Then, the controlling unit 30 drives the motor 10 to rotate the rotational base 6 in such a manner that the second axis X is positioned on a crossing line of a first imaginary plane S including the further two aimed positions Q1 and Q2 and the center O of the spherical lens 1 and the second imaginary plane H (STEP 33).

After the rotating of the rotational base 6 or simultaneously therewith, the controlling unit 30 drives the elevation angle adjusting motor 14 to rotate the arc-shaped arm 12 around the second axis X. Thus, the arc-shaped arm 12 is positioned in such a manner that the arc-shaped arm 12 passes through the aimed positions Q1 and Q2 (STEP 34).

After the driving of the elevation angle adjusting motor 14 or simultaneously therewith, the controlling unit 30 drives the respective guiding motors 21 of the electric feeding units 20 and 23. Thus, the electric feeding units 20 and 23 are moved along the arc-shaped arm 12 to the aimed positions Q1 and Q2 respectively (STEP 35). That is, following (positioning) of the electric feeding unit 23 is achieved while the position Q1 of the electric feeding unit 20 is kept, i.e., in a non-interference manner.

After that, the positioning of the electric feeding unit 20 to follow the satellite 41 and the positioning of the electric feeding unit 23 to follow the satellite 42 are alternatively and successively carried out. Thus, the electric feeding units 20 and 23 can substantially consecutively follow the two satellites 41 and 42.

The antenna devices 26 and 27 are capable of substantially adjoining to each other by making the housing bodies 20*a* and 23*b* come close to each other. Thus, the antenna devices 26 and 27 can follow the satellites 41 and 42 even when the axes from the satellites 41 and 42 through the center O of the spherical lens 1 come close to each other. In addition, the control operation to follow the satellites may be carried out more easily if it is allowed to change correspondences between the two electric feeding units 20 and 23 and the two satellites 41 and 42. In the case, preferably a third (additional) electric feeding unit is provided in such a manner that the third electric feeding unit is also capable of moving along the arc-shaped arm 12. Then, two electric feeding units to follow the two satellites 41 and 42 may be freely chosen from the three electric feeding units. Thus, the control operation to follow the satellites may be carried out more efficiently. In addition, if the third electric feeding unit is provided, the function to follow the two satellites 41 and 42 may not be lost immediately when one of the three electric feeding units breaks down.

When a radio beam is radially radiated from the thus positioned electric feeding unit 20 or 23, the radiated radio beam passes through the integrated dielectric layers of the spherical lens 1 in turn. Thus, the radiation direction of the radio beam is converted into a substantially parallel direction. Therefore, a parallel radio beam is sent to the satellite 41 or 42 (see FIG. 2).

On the other hand, when a parallel radio beam from the satellite 41 or 42 comes into the spherical lens 1, the radio beam converges into a position where the electric feeding unit 20 or 23 is positioned. Therefore, the radio beam is efficiently received by the electric feeding unit 20 or 23 (see FIG. 2).

As described above, according to the embodiment, the two electric feeding units 20 and 23 are arranged for one spherical lens 1 to follow the two satellites 41 and 42 at substantially the same time. Thus, the antenna system can be arranged in a smaller space.

According to the embodiment, since the two electric feeding units 20 and 23 are movable along the arc-shaped arm 12, the interference in the movements of the two electric feeding units 20 and 23 may be extremely effectively prevented.

In addition, according to the embodiment, since the antenna devices 26 and 27 are capable of substantially adjoining to each other, the antenna devices 26 and 27 can follow the satellites 41 and 42 even when the axes extending from the satellites 41 and 42 through the center O of the spherical lens 1 come close to each other.

In the above embodiment, searching the movement of the satellite 41 and moving the electric feeding unit 20 correspondingly to the movement thereof while keeping the position of the electric feeding unit 23, and searching the movement of the satellite 42 and moving the electric feeding unit 23 correspondingly to the movement thereof while keeping the position of the electric feeding unit 20, are alternatively carried out. However, searching the movements (positions) of the two satellites 41, 42 at a combined step and moving the electric feeding units 20, 23 to new aimed positions at a combined step may be carried out.

In the above embodiment, feedback is given for positioning of the electric feeding units 20 and 23 by searching the positions of the satellites 41 and 42. However, for example when the host system gives accurate positional information to the controlling unit 30, the positioning of the electric feeding units 20 and 23 may be carried out with an open-control method based on the positional information. In the case with the open-control method, the positioning of the electric feeding unit 20 and the positioning of the electric feeding unit 23 may be also carried out both alternatively and at a combined step.

Figure 7:
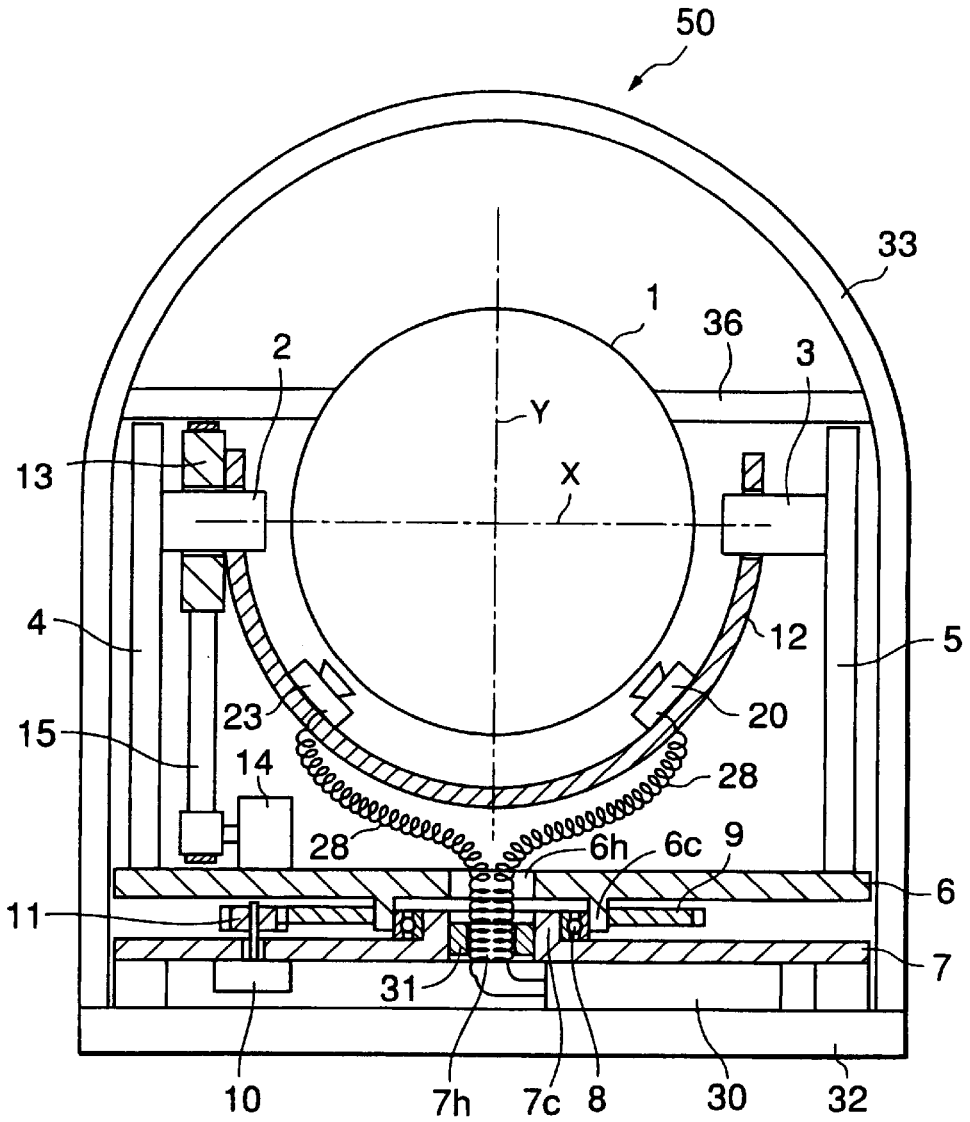
FIG. 7 is a schematically longitudinal sectional view of a second embodiment of the antenna system according to the invention.

Then, a second embodiment of the antenna system according to the invention is explained with reference to FIG. 7. As shown in FIG. 7, in the antenna system 50, the spherical lens 1 is supported by a holding bar 36 fixed to the cover wall 33, instead of by the pair of supporting members. The holding bar 36 is made of a resin. The other structure of the antenna system of the second embodiment is substantially the same as the first embodiment shown in FIGS. 1 to 6. In this embodiment, common numerical signs are used for substantially the same portions and elements as those in the first embodiment.

According to the second embodiment, the spherical lens 1 does not rotate when the rotational base 6 rotates. Thus, performance of controlling the antenna system such as positioning the electric feeding units 20 and 23 is extremely improved.

Of course, the holding bar 36 may be made of any material that has only small possibility to be an obstacle to the radio beam.

Figure 8:
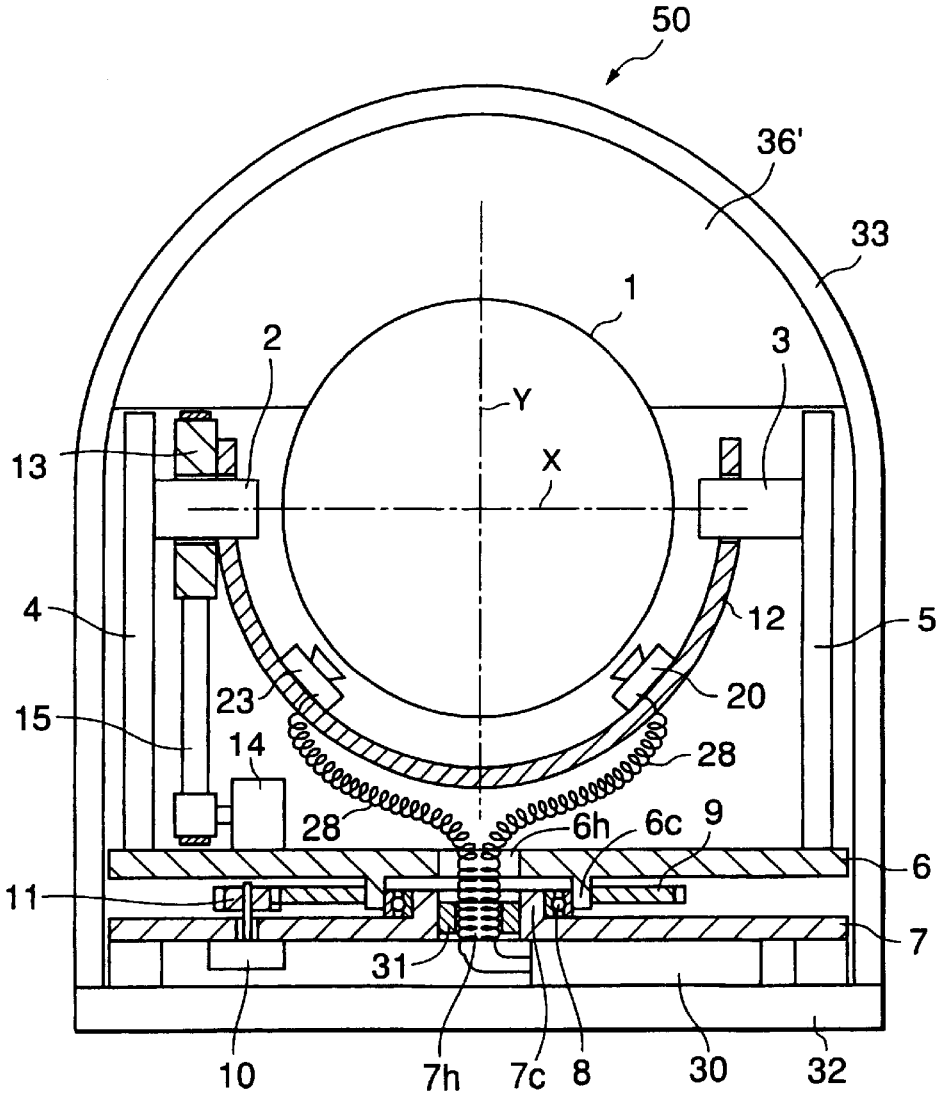
FIG. 8 is a schematically longitudinal sectional view of a third embodiment of the antenna system according to the invention.

Then, a third embodiment of the antenna system according to the invention is explained with reference to FIG. 8. As shown in FIG. 8, in the antenna system 50, the spherical lens 1 is supported and fixed to the cover wall 33 by a holding resin cap 36' filled in a space between the spherical lens 1 and the cover wall 33. The other structure of the antenna system of the third embodiment is substantially the same as the second embodiment shown in FIG. 7. In this embodiment, common numerical signs are used for substantially the same portions and elements as those in the second embodiment.

According to the third embodiment, the spherical lens 1 may be fixed to the cover wall 33 more strongly.

Figure 9:
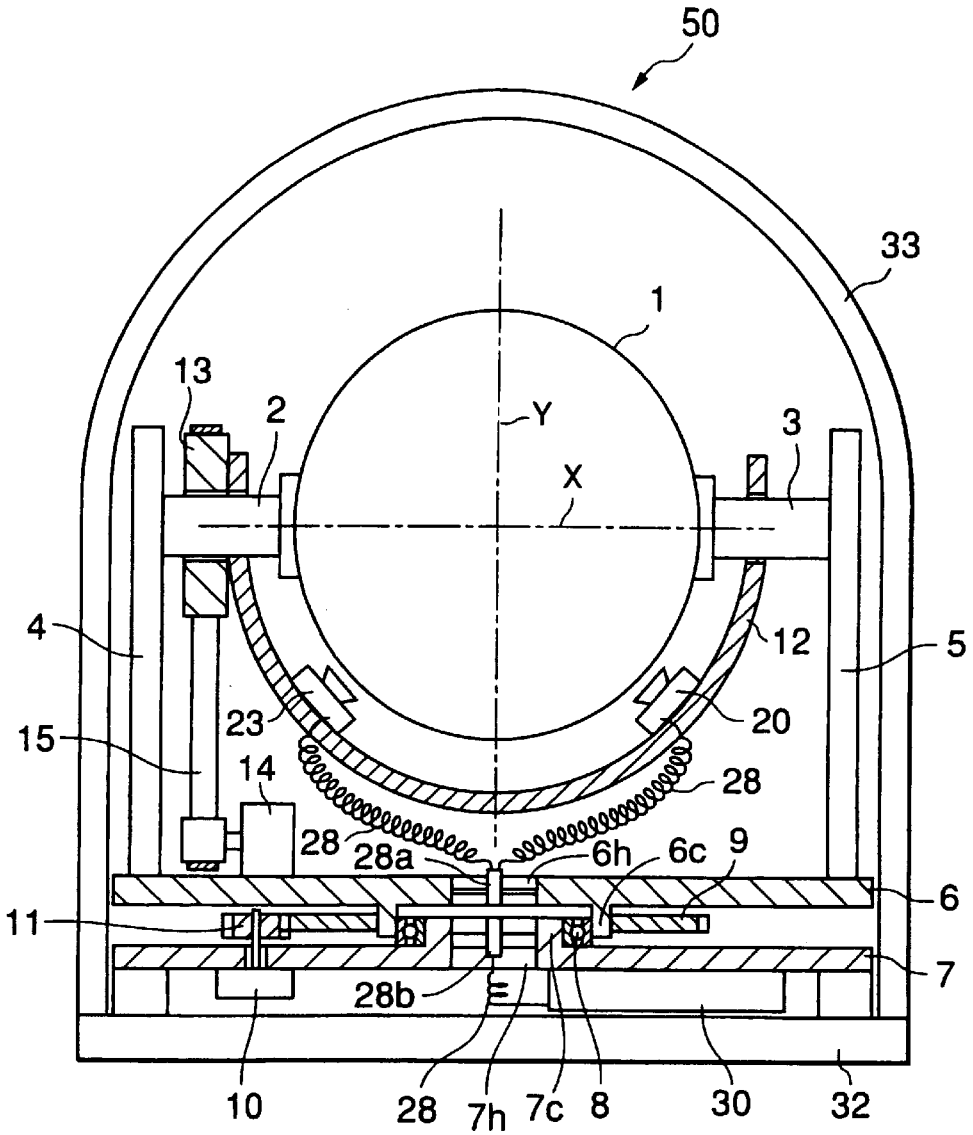
FIG. 9 is a schematically longitudinal sectional view of a fourth embodiment of the antenna system according to the invention.

Then, a fourth embodiment of the antenna system according to the invention is explained with reference to FIG. 9. As shown in FIG. 9, in the antenna system 50, the conductors 28 has a common optical transmitting device between the rotational base 6 and the fixed stage 7. The other structure of the antenna system of the fourth embodiment is substantially the same as the first embodiment shown in FIGS. 1 to 6. In this embodiment, common numerical signs are used for substantially the same portions and elements as those in the first embodiment.

The optical transmitting device includes two optical-electric converting devices 28*a* and 28*b*, which can convert an electric signal into an optical signal or vice versa. The optical-electric converting device 28*a* is fitted into the hole 6*h* disposed at the middle portion of the rotational base 6. The optical-electric converting device 28*b* is fitted into the hole 7*h* disposed at the middle portion of the fixed stage 7. A gap between the optical-electric converting devices 28*a* and 28*b* is about 1 mm. For example, the optical-electric converting devices 28*a* and 28*b* consist of optical coupler elements such as semiconductor lasers or photo detectors.

A signal received by the electric feeding unit 20 or 23 is converted into an electric signal. The electric signal is converted into an optical signal by the optical-electric converting device 28*a*. The optical signal passes through the gap of about 1 mm and reaches to the optical-electric converting device 28*b* disposed at the middle portion of the fixed stage 7. The optical signal is converted back into an electric signal by the optical-electric converting device 28*b*. The electric signal is transmitted to the controlling unit 30 via the corresponding conductor 28. Signal transmitting from the controlling unit 30 to the electric feeding unit 20 or 23 is carried out in the reverse way.

The optical-electric converting devices 28*a* and 28*b* are common to the two electric feeding units 20 and 23. Thus, signal transmitting (signal communication) between the controlling unit 30 and the electric feeding units 20 and 23 is carried out by using two lights having different wavelengths, by means of optical filters such as di-clock mirrors, which are not shown but disposed in the controlling unit 30 and in the electric feeding units 20 and 23 respectively. Similarly, signal transmitting (signal communication) between the controlling unit 30 and the elevation angle adjusting motor 14 is also carried out by using two lights having different wavelengths. In addition, various time-sharing ways may be also used to separate a plurality of signals transmitted at a time.

According to the fourth embodiment, the signals are transmitted between the rotational base 6 and the fixed stage 7 in a non-contact manner. Thus, damage of the conductors 28 may not be caused by the rotation of the rotational base 6 with respect to the fixed stage 7. Therefore, the rotational base 6 can consecutively rotate over one round. Consequently, the antenna system can follow the satellites more smoothly.

The conductors 28 may consist of optical fibers. In the case, signals transmitted in the conductors 28 i.e. the optical fibers are optical signals. Thus, the optic-electric converting devices 28*a* and 28*b* may be replaced with distributors.

Figure 10:
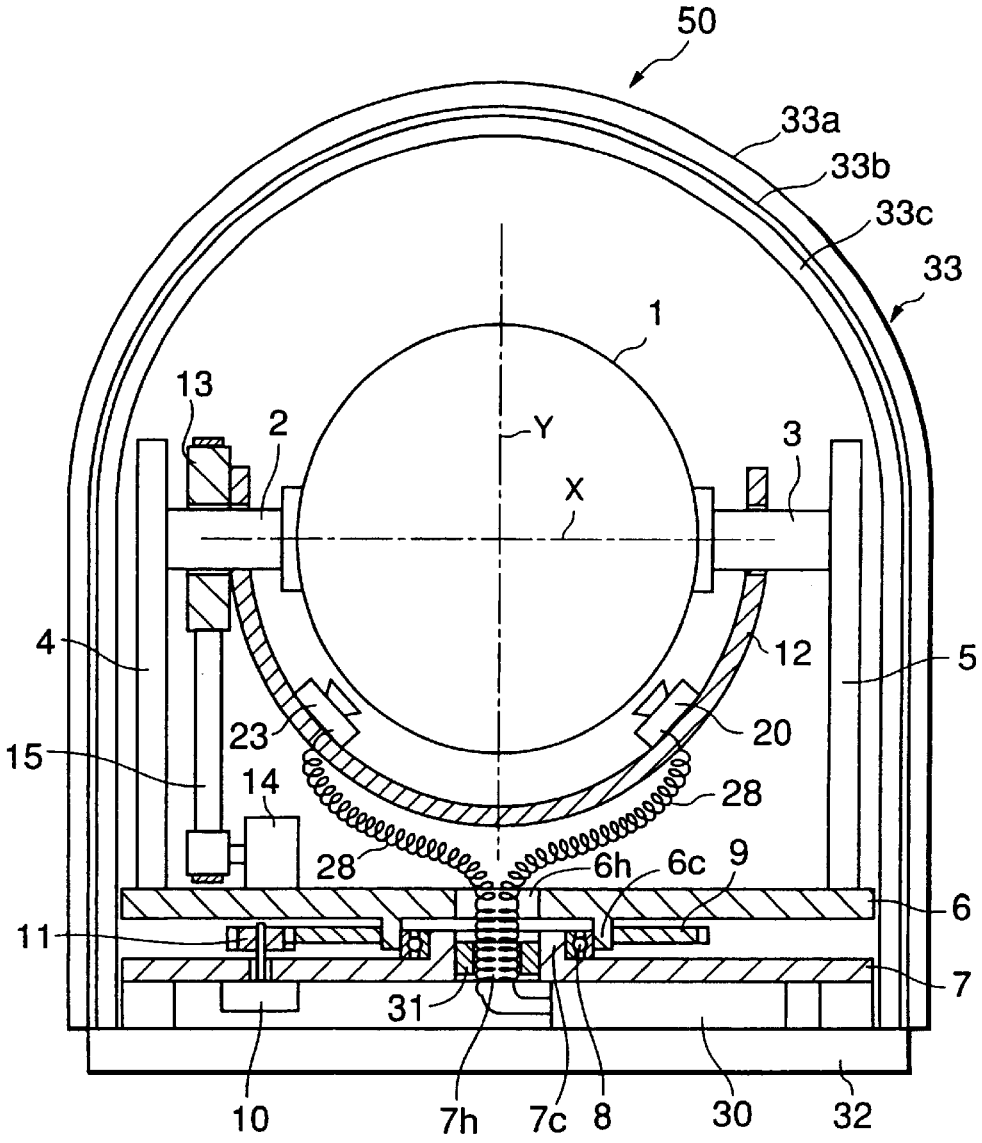
FIG. 10 is a schematically longitudinal sectional view of a fifth embodiment of the antenna system according to the invention.

Then, a fifth embodiment of the antenna system according to the invention is explained with reference to FIG. 10. As shown in FIG. 10, in the antenna system 50, the cover wall 33 consists of an outer layer 33*a* configured to reflect infrared rays, a middle layer 33*b* configured to absorb light and an inner insulating layer 33*c*. The inner insulating layer 33*b* is made of styrene foam. The other structure of the antenna system of the fifth embodiment is substantially the same as the first embodiment shown in FIGS. 1 to 6. In this embodiment, common numerical signs are used for substantially the same portions and elements as those in the first embodiment.

According to the fifth embodiment, most of thermal energy from the sun is reflected by the outer layer 33*a*, and a part of the thermal energy passing through the outer layer 33*a* is absorbed by the middle layer 33*b* and radiated from the fixed base 32. In addition, the inner layer 33*c* prevents the thermal energy from coming into the sealingly covered inner space. These effectively prevents the interior of cover wall 33 of the antenna system 50 from being heated by sunlight.

Figure 11:
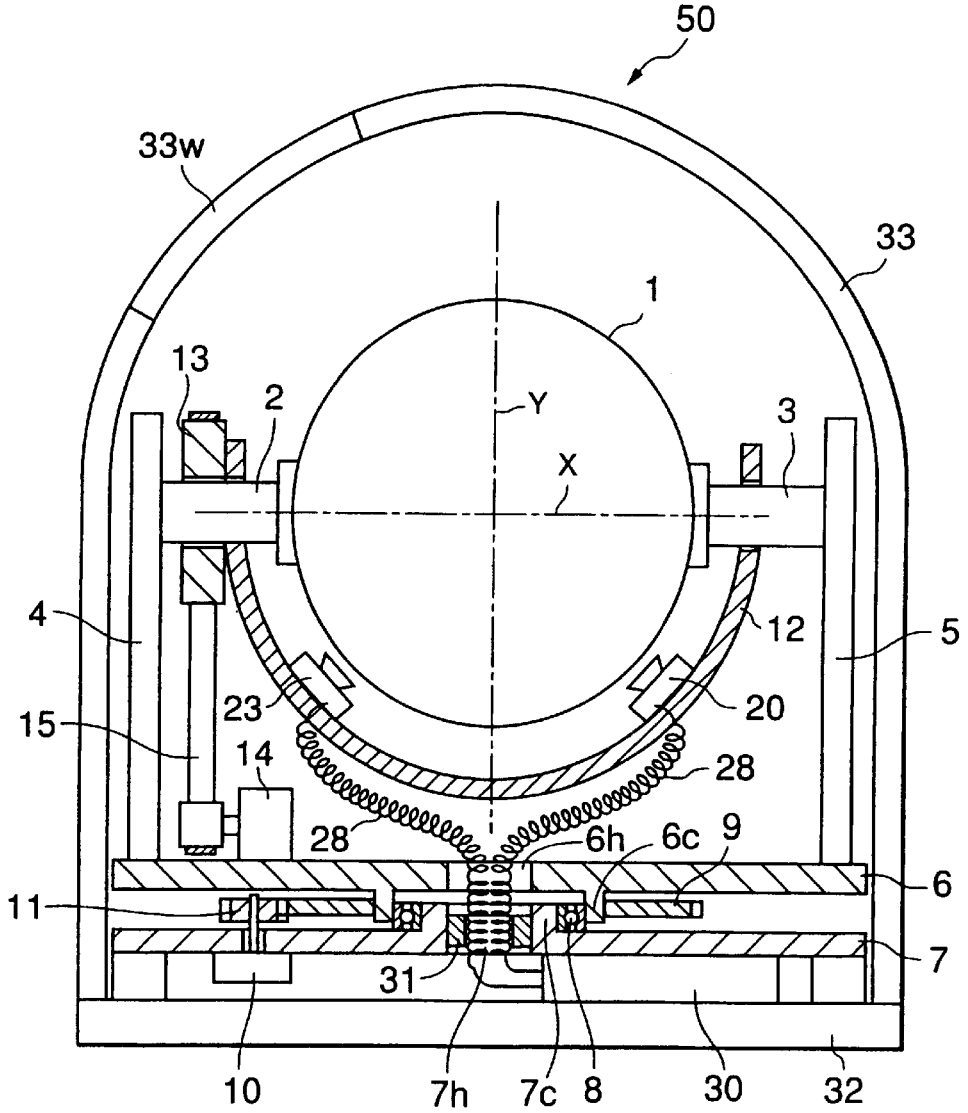
FIG. 11 is a schematically longitudinal sectional view of a sixth embodiment of the antenna system according to the invention.

Then, a sixth embodiment of the antenna system according to the invention is explained with reference to FIG. 11. As shown in FIG. 11, in the antenna system 50, the cover wall 33 has a window 33*w* which is made of a material having a lower transmittance for infrared rays than for visible rays. The other structure of the antenna system of the sixth embodiment is substantially the same as the first embodiment shown in FIGS. 1 to 6. In this embodiment, common numerical signs are used for substantially the same portions and elements as those in the first embodiment.

According to the sixth embodiment, the interior of the cover wall 33 can be seen from the window 33*w*. Thus, inspection for elements or mechanisms in the cover wall 33 can be carried out without taking the antenna system 50 apart.

In the above embodiments, the respective driving mechanisms for rotating the rotational base 6, for adjusting the elevation angle of the arc-shaped arm 12 and for moving the electric feeding units 20 and 23 adopt the driving mechanisms consisting of combined spur gears. However, any known driving mechanism may be adopted. For example, by adding a mechanism including worm gear, the attitudes of the respective elements may be held more strongly and stably.

In addition, the arc-shaped arm 12 may have double tracks, and the electric feeding units 20 and 23 may be adapted to move on and along the respective tracks. In the case, the interference in the movements of the two electric feeding units 20 and 23 may be perfectly prevented. The double tracks are preferably arranged in such a manner that the antenna devices 26 and 27 are capable of adjoining.

According to the invention, the plurality of electric feeding units can be arranged for one spherical lens to follow the plurality of satellites. Thus, the antenna system can be arranged in a smaller space.

What is claimed is:

1. An antenna system comprising:

a plurality of antenna devices respectively configured to send or receive a plurality of radio beams, a plurality of electric feeding units respectively holding the plurality of antenna devices, a spherical lens having a center and causing the plurality of received radio beams to converge into the plurality of antenna devices respectively, a holding rail holding the plurality of electric feeding units in such a manner that the plurality of antenna devices are movable along a substantially constant distance from the center of the spherical lens, a fixed base, a rotational base mounted on the fixed base and rotatable around a first axis through the center of the spherical lens, and a supporting element fixed on the rotational base and supporting the holding rail rotatably around a second axis which is perpendicular to the first axis and which passes through the center of the spherical lens.

2. An antenna system according to the claim 1, wherein:

the plurality of antenna devices are capable of substantially adjoining to each other when the plurality of electric feeding units come close to each other.

3. An antenna system according to the claim 1, wherein:

the supporting element also supports the spherical lens.

4. An antenna system according to the claim 1, wherein:

the holding rail has an arc-shaped arm, at least one of whose ends is supported by the supporting element.

5. An antenna system according to the claim 4, further comprising:

a controlling unit configured to control a rotation of the rotational base around the first axis, a rotation of the arc-shaped arm around the second axis and a movement of each of the plurality of electric feeding units along the holding rail.

6. An antenna system according to the claim 1, further comprising:

conductors respectively connected with the electric feeding units, wherein the conductors pass through a portion of the rotational base substantially adjacent to the first axis toward the fixed base.

7. An antenna system according to the claim 6, wherein:

each of the conductors has an optical transmitting device in order to transmit an optical signal between the rotational base and the fixed base.

8. An antenna system according to the claim 7, wherein:

the optical transmitting device can transmit a plurality of optical signals at a time by using lights having different wavelengths.

9. An antenna system according to the claim 1, further comprising:

a cover wall sealingly covering the plurality of electric feeding units, the spherical lens and the holding rail.

10. An antenna system according to the claim 9, further comprising:

a lens holding member attached to the cover wall and holding the spherical lens.

11. An antenna system according to the claim 9, wherein:

the spherical lens is supported by the cover wall.

12. An antenna system according to the claim 9, wherein:

the cover wall is made of a material having a low thermal conductivity.

13. An antenna system according to the claim 9, wherein:

the cover wall includes a layer configured to reflect infrared rays, a layer configured to absorb light and an insulating layer.

14. An antenna system according to the claim 9, wherein:

the cover wall has a window which is made of a material having a lower transmittance for infrared rays than for visible rays.

15. A method of controlling an antenna system which comprises two antenna devices respectively configured to send or receive two radio beams, two electric feeding units respectively holding the two antenna devices, a spherical lens having a center and causing the received two radio beams to converge into the two antenna devices respectively, a holding rail holding the two electric feeding units in such a manner that the two antenna devices are movable along a substantially constant distance from the center of the spherical lens, a rotational base mounted on the fixed base and rotatable around a first axis through the center of the spherical lens, and a supporting element fixed on the rotational base and supporting the holding rail rotatably around a second axis which is perpendicular to the first axis and which passes through the center of the spherical lens, said method being a method for positioning the two electric feeding units to two aimed positions corresponding to positions of two satellites in a sky, comprising:

inputting the positions of the two satellites into the controlling unit, calculating the two aimed positions which the two electric feeding units should be positioned to and wherein the two antenna devices are respectively on axis extending from the inputted positions of the two satellites through the center of the spherical lens, rotating the rotational base in such a manner that the second axis is positioned on a crossing line of a first imaginary plane including the two aimed positions and the center of the spherical lens and a second imaginary plane including the center of the spherical lens and perpendicular to the first axis, and rotating the holding rail around the second axis and moving the two electric feeding units along the holding rail to the aimed positions respectively.

16. A method according to the claim 15, further comprising:

searching a position of one of the two satellites after movement thereof, calculating new two aimed positions which the two electric feeding units should be positioned to and wherein the two antenna devices are respectively on axis extending from the searched position of the one satellite through the center of the spherical lens and on axis extending from the position of the other satellite before searching through the center of the spherical lens, rotating the rotational base in such a manner that the second axis is positioned on a crossing line of a first imaginary plane including the new two aimed positions and the center of the spherical lens and the second imaginary plane, rotating the holding rail around the second axis and moving the two electric feeding units along the holding rail to the new aimed positions respectively, searching a position of the other satellite after movement thereof, calculating further new two aimed positions which the two electric feeding units should be positioned to and wherein the two antenna devices are respectively on axis extending from the searched position of the one satellite through the center of the spherical lens and on axis extending from the searched position of the other satellite through the center of the spherical lens, rotating the rotational base in such a manner that the second axis is positioned on a crossing line of a first imaginary plane including the further new two aimed positions and the center of the spherical lens and the second imaginary plane, and rotating the holding rail around the second axis and moving the two electric feeding units along the holding rail to the further new aimed positions respectively.

17. A method according to the claim 16, further comprising:

changing correspondences between the two electric feeding units and the two satellites in the sky each other.

18. A method according to the claim 15, further comprising:

searching positions of the two satellites after movements thereof, calculating new two aimed positions which the two electric feeding units should be positioned to and wherein the two antenna devices are respectively on axes extending from the searched positions of the two satellites through the center of the spherical lens, rotating the rotational base in such a manner that the second axis is positioned on a crossing line of a first imaginary plane including the new two aimed positions and the center of the spherical lens and the second imaginary plane, and rotating the holding rail around the second axis and moving the two electric feeding units along the holding rail to the new aimed positions respectively.

19. A method according to the claim 18, further comprising:

changing correspondences between the two electric feeding units and the two satellites in the sky each other.

* * * * *